United States Patent [19]

Hitzrot, Jr.

[11] 4,115,076

[45] Sep. 19, 1978

[54] ABRASIVE MATERIAL SUITABLE FOR MANUALLY BLAST CLEANING FERROUS METALS PRIOR TO PAINTING

[75] Inventor: Henry W. Hitzrot, Jr., Bethlehem, Pa.

[73] Assignee: Bethlehem Steel Corporation, Bethlehem, Pa.

[21] Appl. No.: 800,108

[22] Filed: May 24, 1977

[51] Int. Cl.[2] ..... C21D 7/06; B24C 1/10

[52] U.S. Cl. ..... 51/295; 51/309 R; 51/320; 427/217

[58] Field of Search ..... 51/309, 293, 307, 308, 51/320; 427/212, 216, 217

[56] References Cited

U.S. PATENT DOCUMENTS

| | | | |
|---|---|---|---|
| 446,988 | 2/1891 | Tilghman et al. | 51/309 |
| 1,453,120 | 4/1923 | Beaver | 51/309 |
| 2,059,915 | 11/1936 | Ruch | 51/309 |
| 2,261,639 | 11/1941 | Benner et al. | 51/309 |
| 2,359,401 | 10/1944 | Wulff | 51/309 |
| 2,895,816 | 7/1959 | Cline | 51/309 |
| 3,511,718 | 5/1970 | Segura | 427/216 |
| 3,767,477 | 10/1973 | McCabe et al. | 427/216 |
| 3,844,844 | 10/1974 | Sato | 51/309 |

*Primary Examiner*—Donald J. Arnold

*Attorney, Agent, or Firm*—Joseph J. O'Keefe; Charles A. Wilkinson; John S. Simitz

[57] ABSTRACT

A non-toxic abrasive material used to manually blast clean the surface of ferrous metals prior to painting comprised of generally spherical particles containing 85% iron, the remainder being substantially oxygen and minor amounts of elements usually found in carbon and alloy steels, and having a metallic core containing 30% to 50% of the iron as metallic iron surrounded by a shell containing the remaining 50% to 70% of the iron as iron oxides. The abrasive material is characterized by having a specific gravity of 5 to 6 and a bulk density of 180 pounds per cubic foot (2.88 grams per cubic centimeter). It is preferred to use particles within the size range of −6, +100 mesh for manual blast cleaning purposes, however particles which are −100 mesh size can be used in special applications.

9 Claims, 4 Drawing Figures

ABRASIVE MATERIAL SUITABLE FOR MANUALLY BLAST CLEANING FERROUS METALS PRIOR TO PAINTING

BACKGROUND OF THE INVENTION

This invention is directed to an abrasive material, prepared from a steel plant waste product, which can be used as a substitute for mineral abrasives or sand to manually blast clean the surface of ferrous metals prior to painting.

Sand is the oldest abrasive which has been used to remove contaminants from the surface of ferrous metals. Sand is plentiful, hard, efficient and relatively cheap. However, sand is brittle and has a high breakdown rate when impacted at high velocity on the surface which is being blast cleaned. Small discrete particles of sand are produced, forming large volumes of dust. Vision is thus impaired during cleaning. The particles of dust settle on the surface being cleaned and on all adjacent areas, necessitating major cleanup of the blasted surface and the adjacent areas after blasting. It is, as a consequence, necessary to protect all surrounding machinery and operators. Sand is essentially silica. Continued inhalation of the discrete small particles of sand can cause silicosis. As a result, substitute abrasives for sand have been sought.

Both metallic and non-metallic abrasives have been developed to replace sand. Metallic abrasives are produced by special processes. The abrasives are hard and tough and have long breakdown rates. However, metallic abrasives are expensive and are generally limited to indoor or protected corrosion free atmospheres wherein the particles can be reclaimed and recycled between 50 and 5,000 times so that their use is economically feasible.

Mineral or non-metallic abrasives are generally less dense and lighter and more brittle than metallic abrasives. Mineral abrasives generally are similar to sand and have a high breakdown rate. They are used in the same applications as sand, i.e. applications in which the abrasives are not reclaimed. Because of their high breakdown rate, large volumes of dust are generated when manually blast cleaning ferrous surfaces. Many of the mineral abrasives contain silica and are more or less toxic. Because of their high breakdown rate it is necessary to clean the blasted surface and surrounding areas to remove excess dust. Mineral abrasives are packaged in narrow size ranges, hence one size of an abrasive is used to remove coarse contaminants and another size is used to remove light contaminants. A mixture of two sizes of mineral abrasives is required to clean both coarse and light contaminants at the same time. However, this practice can and does result in folded-in dirt and rust on the blasted surface.

Scarfer spittings are a waste product produced in steel preparation shops. Scarfing is defined as a process for removing surface defects from ingots, billets, bars, etc. by means of a gas torch. Scarfer spittings are spherical-like waste particles ranging in size from +2 inches to less than 100 mesh sieve size formed during scarfing. The scarfer spittings are initially molten steel and are usually quenched in water to cool before handling. Scarfer spittings contain a metallic iron core and a shell of iron oxides surrounding the core. Because of the presence of iron it has been proposed to use the scarfer spittings as part of the charge to sintering machines. In fact a small percentage of scarfer spittings are so used.

Attempts to reclaim the iron in scarfer spittings along with other in-plant waste materials such as mill scale and fume to make heat hardened pellets suitable for charging into metallurgical furnaces have not been commercially successful. Since the quantity of scarfer spittings which are reclaimed is relatively small, it is necessary to store them when they are removed from the steel plants or else discard them. Both handling and storage are expensive in terms of labor and storage area.

SUMMARY OF THE INVENTION

It has been found that the problems inherent in the use of sand and mineral abrasives can be avoided by using an abrasive made from scarfer spittings which are a steel preparation plant waste product. The abrasive particles are preferably −6,+100 mesh in size, however, −100 mesh size particles are used in special applications. The particles are generally spherical in shape and contain 85% iron, the remainder being substantially oxygen and minor amounts of elements usually found in carbon and alloy steels, and are comprised of a metallic core containing 30% of the iron as metallic iron and a shell surrounding the core containing 70% of the iron as iron oxides. The abrasive is characterized by having a specific gravity of 5 to 6 and a bulk density of not less than 180 pounds per cubic foot (2.88 grams per cubic centimeter).

FIGURES OF THE INVENTION

PREFERRED EMBODIMENT OF THE INVENTION

Figure 1:
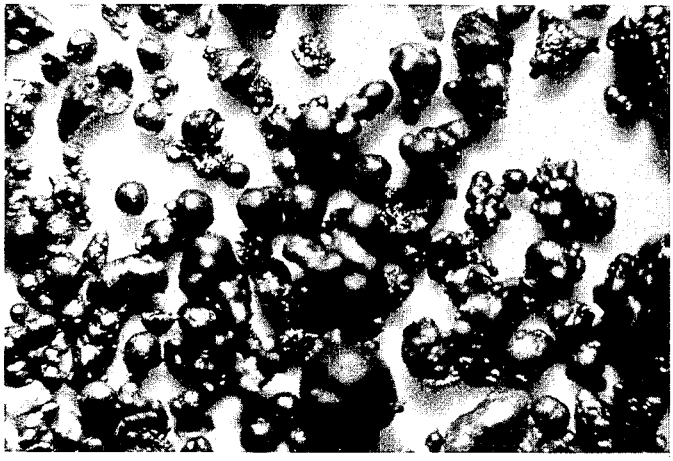
FIG. 1 is a reproduction of a photomicrograph of particles of scarfer spittings which are used as an abrasive to manually blast clean ferrous metals, taken at a magnification of eight times normal size.

It has been found that scarfer spittings, a waste product produced in steel preparation shops by scarfing semi-finished steel products, can be prepared and used as abrasive particles to manually blast clean ferrous metals prior to painting. The waste product is used as a substitute abrasive for sand and mineral abrasives and contains particles which are −6 mesh in size and preferably −6,+100 mesh. The particles of the abrasive contain 85% iron, the remainder being oxygen and minor amounts of elements usually found in carbon and alloy steels, such as carbon, manganese, phosphorus, sulfur and silicon, and alloying elements; are more dense than mineral abrasives; are substantially free of silica; produce little if any dust during manual blast cleaning; produce a low profile surface on the ferrous metal and little, if any, "folded-in" dirt or dust. The particles are comprised of a metallic core which contains 30% to 50% of the iron and a shell surrounding the core which contains the remaining 50% to 70% of the iron as iron oxides.

Scarfer spittings collected in steel preparation plants contain particles within a wide size range, for example +2,−325 mesh. Some foreign matter which is greater than 2 inches in size is inadvertently collected with the scarfer spittings.

It has been found that particles having a size range of −6,+100 mesh are most useful in manual blast cleaning ferrous metals. It is, therefore, necessary to screen the as-collected scarfer spittings to separate particles within the desired range from oversize particles and foreign matter. The as-collected scarfer spittings are screened on a two inch screen to separate all the large foreign matter and the +2 inch size particles from the −2 inch size particles. The foreign matter can be separated from the +2 inch size particles of scarfer spittings by any well known means if desired to recover the +2 inch size particles, which particles can be recycled in the plant as part of the raw material feed to a sinter strand in a sintering plant. The foreign matter is discarded. The foreign matter and +2 inch particles comprise between 1% and 2% by weight of the total amount of scarfer spittings. The −2 inch particles comprise at least 98% by weight of the scarfer spittings. The −2 inch particles are screened a second time to make a size separation at 6 mesh. The +6 mesh particles are recycled to the plant and can also be used as part of the feed to the sinter strand. All the −6 mesh particles are dried in a commercial dryer such as a rotary dryer or fluid bed dryer at a temperature of about 300° F (149° C) by passing heated air through the bed of particles. It is preferred to use particles within a size range of −6,+100 mesh for manually blast cleaning the surface of ferrous metals. Drying in a fluid bed dryer has the advantage of removing substantially all the −100 mesh particles from the −6 mesh particles, hence the material dried in a fluid dryer does not need to be screened after drying. Because there is no separation of particles by size when drying in a rotary dryer, the −6 mesh particles are screened after drying to separate the −100 mesh particles from −6,+100 mesh particles. Particles which are coarser than 6 mesh can cause a surface which is relatively rough. The rough surface requires more paint to cover the peaks than a relatively smooth or low profile surface, therefore particles less than 6 mesh are used in the abrasive substitute. Particles which are finer than 100 mesh are too small and too light to clean contaminants from the surface of most ferrous metals in a reasonable period of time, hence are not economical to use. It has been found, however, that the −100 mesh particles are particularly useful to manually blast clean light contaminants such as thin films of scale which form on the surfaces of small ferrous parts, such as steam turbine blades and rotors.

Steam turbine blades and rotors used to generate electricity in power plants become coated with a thin film of scale during use. It is necessary from time to time to clean the film of scale from the surfaces of the blades and rotors. The blades and rotors must be cleaned without distorting their shape or removing any metal or work hardening their surfaces. I have found that the −100 mesh particles of scarfer spittings are ideally suited for removing the thin film of scale from the surfaces of the turbine blades and rotors without distorting their shape, removing any metal or work-hardening their surfaces.

In these specifications and claims wherever screen and sieve sizes are shown such screen and sieve series are United States Series Sieves. Also, wherever a chemical analysis is shown such analysis is on a weight basis. Wherever iron is mentioned, I mean elemental iron.

A typical size consist of scarfer spittings is shown in Table I:

Table I

| Screen Analysis (Weight Percent) of Scarfer Spittings | | |
|---|---|---|
| Coarse Fraction | (+6 particles) | 5.1%* |
| Intermediate Fraction | (−6, +100 particles) | 66.5% |
| Fine Fraction | (−100 particles) | 25.9% |
| Moisture | | 2.5% |

*-About 1% of this fraction is in the form of large foreign matter and +2 inch particles.

The screen analysis shows that more than a major portion of the scarfer spittings comprise particles within the size range which are preferred to be used as abrasive material in manually blast cleaning the surface of ferrous metals. As noted above, the fine fraction, which is about 26% of the particles, can be used to manually blast clean the surfaces of turbine blades and rotors.

A typical screen analysis of the intermediate fraction (−6,+100 mesh size particles) shown in Table I, is shown below in Table II:

Table II

| Screen Analysis of the Intermediate Fraction of Scarfer Spittings | |
|---|---|
| | Product |
| Sieve Size | Weight % Cumulative |
| 6 | — |
| 8 | 1.4 |
| 12 | 6.6 |
| 16 | 14.9 |
| 20 | 26.7 |
| 30 | 43.6 |
| 40 | 64.7 |
| 50 | 88.2 |
| 70 | 99.0 |
| 100 | 99.8 |
| Pan | — |

The screen analysis shows that an insignificant amount, about 0.2% by weight, of the particles in the intermediate or preferred fraction is finer than 100 mesh in size.

A typical chemical analysis of the particles of scarfer spittings is shown below in Table III:

Table III

| Chemical Analysis of the Particles of Scarfer Spittings | |
|---|---|
| Element | Weight % |
| $Fe^{Total}$ | 88.2 |
| $Fe^{o}$ | 49.5 |
| $Fe^{++}$ | 26.6 |
| $Fe^{+++}$ | 9.1 |
| Mn | 0.38 |
| P | 0.004 |
| S | 0.015 |
| C | 0.052 |

A commercially available boiler slag used to manually blast clean ships plates was tested for size consist and chemical analysis and compared with the scarfer spittings. The results are shown in Table IV below:

Table IV

| Screen Analysis and Chemical Analysis Of Commercially Available Mineral Abrasives | | | |
|---|---|---|---|
| Screen Analysis | | Chemistry | |
| Sieve Size | Weight % Cumulative | | Weight % |
| 6 | — | $Fe^{Total}$ | 15.5 |
| 8 | 1.7 | CaO | 1.9 |
| 12 | 30.4 | MgO | 1.2 |
| 16 | 71.5 | $Al_2O_3$ | 2.09 |
| 20 | 93.4 | $SiO_2$ | 51.1 |
| 30 | 98.9 | S | 0.25 |

Table IV-continued

| Screen Analysis and Chemical Analysis Of Commercially Available Mineral Abrasives | | | |
|---|---|---|---|
| Screen Analysis | | | |
| Sieve Size | Weight % Cumulative | Chemistry | Weight % |
| 40 | 99.6 | $Na_2O$ | 0.37 |
| 50 | 99.7 | $Vi_2O$ | 1.71 |
| 70 | 99.8 | $Li_2O$ | <0.05 |
| 100 | 99.9 | | |
| Pan | 0.1 | | |

From Tables III and IV above, it can be seen that over 60% by weight of the particles in the intermediate fraction of scarfer spittings are within the size range of −6,+40 mesh and the remaining particles are within the size range of −40,+100 mesh, whereas 99.6% by weight of the boiler slag particles are within the −6,+40 mesh range and an insignificant amount of the particles are finer than 40 mesh. Obviously, the size range of the particles, which comprise the scarfer spittings, is much broader than the particles of boiler slag. Coarser particles are used to remove heavy contaminants such as scale and finer particles are used to remove light contaminants such as fine rust. Obviously, the boiler slag is particularly adapted to remove scale but will not effectively remove rust. The coarser particles impinge on the rust embedding it in the surface being cleaned. The particles of scarfer spittings, on the other hand, are effective in removing both scale and rust without any embedded rust.

It can also be seen that the boiler slag composition, which contains only 51% silica by weight, is an improvement over sand. However, the high percentage of silica presents a health hazard to the operator. The scarfer spittings, on the other hand, are substantially free of any silica, hence do not pollute the atmosphere with harmful silica nor are they a health hazard to the operator.

Turning now to the Figures, FIG. 1 shows typical particles of scarfer spittings. The particles have a generally spherical shape or are tending to spheroidize. A portion of the particles may be angular, however these particles can also be thought of as tending to spheroidize.

Figure 2:
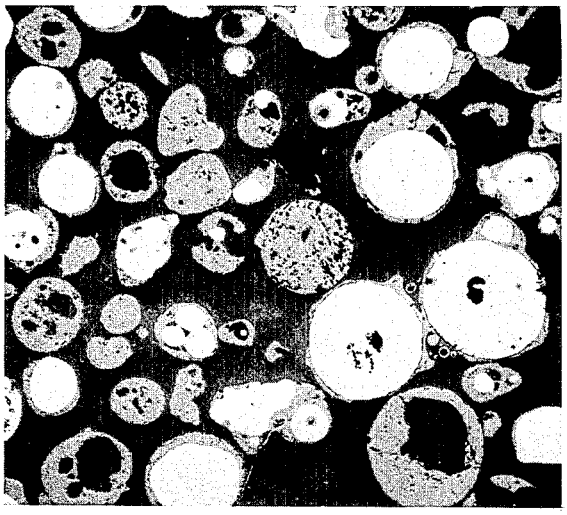
FIG. 2 is a reproduction of a photomicrograph showing the cross-section of several particles of scarfer spittings taken at a magnification of 30 diameters.

A portion of the particles was mounted in plastic, polished and examined microscopically. The cross-section of the particles is shown in FIG. 2. The white areas, W, are metallic cores. The lighter gray areas, LG, are iron oxide shells encapsulating the cores, W. The black areas, B, are voids and the darker gray areas, P, are part of the plastic used to mount the particles.

It was found that the particles have a specific gravity between 5 and 6, which specific gravity is higher than the 2 to 3 specific gravity range of blast furnace slags, boiler slags, sands and the like. The relatively high specific gravity of the particles and their relatively high bulk density which is about 180 pounds per cubic foot (2.88 grams per cubic centimeter) result in excellent cutting power and is one of the reasons for the efficiency of the particles when used as a manual blast cleaning abrasive. The useful fraction of the particles contains a range of sizes, hence the removal of both heavy contaminants such as mill scale and light contaminants such as rust is accomplished. The particles do not undercut the surface of the ferrous metal being blast cleaned nor do they penetrate too deeply beneath the surface, hence the profile of the ferrous metal surface is much smoother than the profile produced by mineral abrasives. As a result, the blast cleaned ferrous surfaces are more easily covered by a coating of paint. There is little if any "folded in" dirt, mill scale or rust on the surfaces of steel which are blast cleaned with the particles of scarfer spittings. Additionally, little if any residual abrasive is left on the steel surface. As a result, there is less chance of coating failure as compared to a mineral abrasive blast cleaned surface. The particles of scarfer spittings do not contain silica, therefore they are non-toxic.

Figure 3:
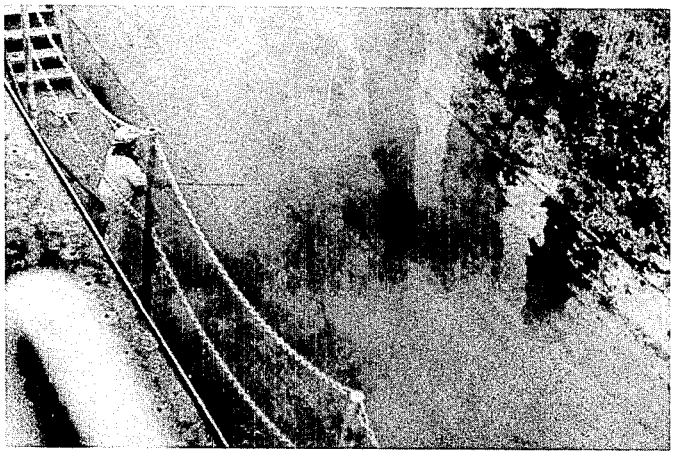
FIG. 3 is a reproduction of a photograph showing manual blast cleaning the surface of steel plates with a commercially available mineral slag.
Figure 4:
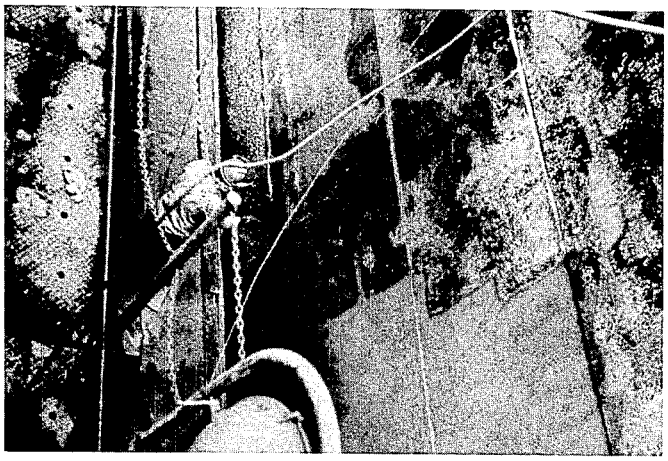
FIG. 4 is a reproduction of a photograph showing manual blast cleaning the surface of steel plates with the abrasive material of the invention.

A comparison of the environment around ships plates which are being manually blast cleaned with a commercially available boiler slag and with particles of scarfer spittings is shown in FIGS. 3 and 4, respectively. A relatively large dust cloud is produced when using the commercial boiler slag, obscuring vision and polluting the atmosphere as seen in FIG. 3. On the other hand, there is little if any dust created when manually blast cleaning with the intermediate fraction of the scarfer spittings. Vision remains excellent as seen in FIG. 4. It is obvious that the environment in the area of the blast cleaning operation is polluted when using the commercial abrasive whereas there is little pollution of the environment when using the particles of scarfer spittings. Steel plates can be blast cleaned more efficiently and in about 25% less time by using particles of scarfer spittings instead of using a mineral abrasive such as boiler slag.

In a specific example of the invention, 172 tons of scarfer spittings per day are prepared for use by primary screening on a 2 inch screen, secondary screening on a #6 mesh screen and by drying in a fluid bed. The intermediate fraction of scarfer spittings obtained was about 112 tons. The intermediate useful fraction of the scarfer spittings had a size analysis as shown in Table V below:

Table V

| Screen Analysis of the Intermediate Fraction of the Scarfer Spittings | |
|---|---|
| | Product |
| Sieve Size | Weight % Cumulative |
| 6 | — |
| 8 | 1.4 |
| 12 | 6.6 |
| 16 | 14.9 |
| 20 | 26.7 |
| 30 | 43.6 |
| 40 | 64.7 |
| 50 | 88.2 |
| 80 | 99.0 |
| 100 | 99.8 |
| Pan (Including 200) | 0.2 |

The chemical analysis of the particles of scarfer spittings is shown below:

| Element | % by Weight |
|---|---|
| $Fe^{Total}$ | 88.2 |
| $Fe^{o}$ | 49.5 |
| $Fe^{++}$ | 26.6 |
| $Fe^{+++}$ | 9.1 |
| Mn | 0.38 |
| P | 0.004 |
| S | 0.015 |
| C | 0.052 |

The particles of scarfer spittings were used to manually blast clean steel plates which were contaminated with paint and rust. About 36.3 tons of the scarfer spittings were used to clean the steel plates to a cleanliness suitable for repainting. The steel plates were considered clean after 44.4 hours of blast cleaning. The steel plates were free of "folded-in" dirt, mill scale or rust and substantially no residual abrasive left on the steel surfaces. There was no trace of silica. In a similar application, 50.1 tons of a typical boiler slag required 50.4 hours to clean steel plates of equivalent surface area. The size consist and the chemical analysis of the boiler slag are shown below in Table VI:

Table VI

| Screen Analysis of Boiler Slag | |
|---|---|
| | Product |
| Sieve Size | Wt. % Cumulative |
| 6 | — |
| 8 | 1.7 |
| 12 | 30.4 |
| 16 | 71.5 |
| 20 | 93.4 |
| 30 | 98.9 |
| 40 | 99.6 |
| 50 | 99.7 |
| 80 | 99.8 |
| 100 | 99.9 |
| Pan | 0.1 |

| Chemical Analysis | |
|---|---|
| Element | % By Weight |
| $Fe^{Total}$ | 15.5 |
| CaO | 1.9 |
| MgO | 1.2 |
| $Al_2O_3$ | 20.9 |
| $SiO_2$ | 51.1 |
| S | 0.25 |
| $Na_2O$ | 0.37 |
| $K_2O$ | 1.71 |

Portions of the steel plates were found to have "folded in" dirt. Some of the rust was found embedded in the steel plates. Substantial amounts of residual abrasive containing silica was left on the surfaces of the steel plates. Because of the cleaning capabilities of the scarfer spittings, the amount of material per unit time is much less than the amount of boiler slag per unit time for cleaning purposes.

I claim:

1. An abrasive material used to manually blast clean the surface of metals in situ, comprising scarfer spittings having particles which have a size of −6 mesh characterized by having a iron containing core surrounded by a shell of iron oxides, a specific gravity of 5 to 6 and a bulk density of not less than 180 pounds per cubic foot (2.88 grams per cubic centimeter).

2. An abrasive material as claimed in claim 1 in which the particles are within a size range of −6,+100 mesh.

3. An abrasive material as claimed in claim 1 in which the particles have a size of −100 mesh.

4. An abrasive material as claimed in claim 1 in which the particles are non-toxic and substantially dust free.

5. An abrasive material used to manually blast clean metallic structures and products in situ, prepared from a waste product produced by scarfing steel blooms, slabs, billets and bars, said waste product being screened on a first screen to separate and discard foreign matter and particles which are larger than two inches in size from all the particles which are −2 inches in size, screening the −2 inch particles on a second screen to separate all the +6 mesh particles from the −6 mesh particles; recycling the +6 mesh particles to a sintering plant; drying and dedusting the −6 mesh particles in a fluid bed dryer to remove substantially all the −100 mesh particles, said abrasive material being characterized by containing 85% iron and the remainder substantially oxygen and amounts of elements usually found in carbon and alloy steels, being generally spherical in shape and having a metallic core containing between 30% and 50% of said iron surrounded by a shell containing between 50% and 70% of the iron as substantially all iron oxides; a specific gravity of 5 to 6 and a bulk density of not less than 180 pounds per cubic foot (2.88 grams per cubic centimeter).

6. An abrasive material used to manually blast clean the surfaces of steel structures and products in situ, prepared from a waste product produced by scarfing steel blooms, slabs, billets and bars, said waste product being screened on a first screen to separate and discard foreign matter and particles which are larger than two inches in size from all the particles which are −2 inches in size, screening the −2 inch particles on a second screen to separate all the +6 mesh particles from the −6 mesh particles; recycling the +6 mesh particles to a sintering plant; drying the −6 mesh particles in a rotary dryer to remove substantially all the −100 mesh particles and screening the dried particles on a third screen to separate the −100 mesh particles from the −6,+100 mesh particles, said abrasive material being characterized by containing 85% iron and the remainder being substantially oxygen and amounts of elements usually found in carbon and alloy steels, being generally spherical in shape and having a metallic core containing between 30% and 50% of said iron surrounded by a shell containing between 50% and 70% of the iron as substantially all iron oxides; a specific gravity of 5 to 6 and a bulk density of not less than 180 pounds per cubic foot (2.88 grams per cubic centimeter).

7. In a method for manually blast cleaning the surface of a ferrous metal to remove light and heavy contaminants therefrom to prepare said surface for painting by contacting said surface with particles of an abrasive material at a velocity sufficient to remove said light and heavy contaminants without undercutting said surface and leaving said surface substantially free from entrapped contaminants and said abrasive material and with a minimum formation of dust during said blast cleaning, the improvement comprising impinging particles of scarfer spittings having a size within the range of −6,+100 mesh comprised of 85% iron and the remainder being substantially oxygen and amounts of elements usually found in carbon and alloy steels, said scarfer spittings being characterized by having a metallic core containing between 30% and 50% of said iron and a shell surrounding said metallic core, containing between 50% and 70% of said iron as substantially all iron oxides and a specific gravity of between 5 and 6.

8. In a method to manually blast clean the surface of rotor blades and turbines by impinging particles of an abrasive material thereon at sufficient pressure to remove light scale without removing any metal therefrom, said particles being scarfer spittings having a size of −100 mesh and characterized by containing 85% iron and the remainder being oxygen and amounts of elements usually found in carbon and alloy steels and having a specific gravity between 5 and 6, said particles comprising a metallic core containing between 30% and 50% of said iron and a shell surrounding said metallic core containing between 50% and 70% of said iron as substantially all iron oxides.

9. The abrasive material as claimed in claim 1 wherein the scarfer spittings consist essentially of 85 weight percent iron, the remainder being oxygen and elements usually found in carbon and alloy steels, said metallic core containing between 30 weight percent and 50 weight percent of the iron and said shell containing between 50 weight percent and 70 weight percent of the iron as iron oxides.

* * * * *